US007959855B2

(12) United States Patent
Budihartono

(10) Patent No.: US 7,959,855 B2
(45) Date of Patent: Jun. 14, 2011

(54) WHITE PRECIOUS METAL ALLOY

(76) Inventor: Heru Budihartono, Surayaba (ID)

( * ) Notice: Subject to any disclaimer, the term of this patent is extended or adjusted under 35 U.S.C. 154(b) by 0 days.

(21) Appl. No.: 11/802,290

(22) Filed: May 22, 2007

(65) Prior Publication Data

US 2008/0095659 A1 Apr. 24, 2008

Related U.S. Application Data

(60) Provisional application No. 60/852,676, filed on Oct. 19, 2006.

(51) Int. Cl.
*C22C 5/06* (2006.01)
*C22C 5/02* (2006.01)
*C22C 5/00* (2006.01)

(52) U.S. Cl. ..... 420/505; 420/501; 420/502; 420/503; 420/504; 420/506; 420/507; 420/510; 420/511; 420/512; 148/430

(58) Field of Classification Search ..... 420/501–512, 420/463–468, 580, 587, 590, 591; 148/430, 148/442, 419, 431; *C22C 5/00, 5/02, 5/04, C22C 5/06, 30/00, 30/02, 30/06*
See application file for complete search history.

(56) References Cited

U.S. PATENT DOCUMENTS

| | | | | | |
|---|---|---|---|---|---|
| 2,050,077 | A | | 8/1936 | Wise | |
| 2,058,857 | A | | 10/1936 | Emmert | |
| 2,196,302 | A | * | 4/1940 | Hensel et al. | 420/502 |
| 2,198,400 | A | | 4/1940 | Williams | |
| 2,716,605 | A | | 8/1955 | Schatz | |
| 3,849,543 | A | * | 11/1974 | Zirngibl et al. | 423/613 |
| 3,981,723 | A | | 9/1976 | Tuccillo | |
| 4,111,690 | A | | 9/1978 | Harmsen | |
| 4,396,578 | A | * | 8/1983 | Bales | 420/587 |
| 4,522,783 | A | * | 6/1985 | Menicucci | 420/503 |
| 4,892,582 | A | | 1/1990 | Diehl et al. | |
| 5,021,214 | A | | 6/1991 | Sasaki et al. | |
| 5,240,172 | A | | 8/1993 | Steinke et al. | |
| 5,290,371 | A | | 3/1994 | Cameron et al. | |
| 5,372,779 | A | * | 12/1994 | Reti | 420/505 |
| 5,452,754 | A | * | 9/1995 | Yasui | 164/287 |
| 5,635,131 | A | | 6/1997 | Klotz et al. | |
| 5,833,774 | A | | 11/1998 | Klein et al. | |
| 5,876,862 | A | * | 3/1999 | Shibuya et al. | 428/672 |
| 5,919,320 | A | | 7/1999 | Agarwal et al. | |
| 6,290,501 | B1 | | 9/2001 | Grau et al. | |
| 6,540,511 | B1 | | 4/2003 | Cavaf | |
| 6,951,588 | B1 | | 10/2005 | Bernhard et al. | |
| 7,135,078 | B1 | | 11/2006 | Agarwal et al. | |

FOREIGN PATENT DOCUMENTS

| | | | |
|---|---|---|---|
| DE | 44 23 646 | | 8/1995 |
| EP | 0057149 | * | 8/1982 |
| FR | 2576321 | A1 | 7/1986 |
| FR | 2 798 580 | | 3/2001 |
| GB | 683 004 | | 11/1952 |
| JP | 9 078160 | | 3/1977 |
| JP | 60-204847 | * | 10/1985 |
| JP | 61-060852 | * | 3/1986 |
| JP | 3 130332 | | 6/1991 |
| JP | 3 130333 | | 6/1991 |
| JP | 3 130334 | | 6/1991 |
| JP | 3 130335 | | 6/1991 |
| JP | 3 130336 | | 6/1991 |
| JP | 06-049562 | * | 2/1994 |
| JP | 6 184665 | | 7/1995 |
| JP | 9 137240 | | 5/1997 |
| JP | 2000 336439 | | 12/2000 |
| JP | 2001-020024 | * | 1/2001 |
| JP | 2004 060045 | | 2/2004 |
| JP | 2005 163160 | A1 | 6/2005 |
| NL | 9200566 | * | 10/1993 |
| RU | 2 115 755 | | 7/1998 |
| WO | WO 03/028669 | | 4/2003 |

OTHER PUBLICATIONS

JP 2005-163160. Shimizu et al. Published Jun. 23, 2005. English machine translation attached.*

Translation of JP 2005-163160 entitled "Silver Alloy for a Precious Body Decoration Tool". Translation completed by the McElroy Translation Company.*

Machine translation of EP0057149. 5 pages total.*

Computer-generated translation of JP 06-049562.*

Computer-generated translation of JP 2001-020024.*

Translation of JP 60-204847, provided by FLS, Inc.*

Professional translation of JP 61-060852, published in the Japanese language on Mar. 28, 1986.*

International Search Report mailed Apr. 30, 2008, in International Application No. PCT/IB2007/003516 dated Apr. 30, 2008.

Dieter Ott, "Optimising Gold Alloys for the Manufacturing Process—Advantage and Disadvatage of Small Alloying Additions," Gold Technology, vol. 34, pp. 37-44 (Spring 2002) (Available at http://www.gold.org/discover/sci_indu/Gtech/index.php?issue=Gt_34.html.

Peter Rotheram et al., "White Golds—Meeting the Demand of International Legislation," Gold Technology, vol. 27, pp. 34-40 (Winter 1999) *available at* http://www.gold.org/discover/sci_indu/GTech/1999_27/WhiteGolds.pdf (publication date unknown).

Steven Henderson et al, "White Gold Alloys: Colour Measurement and Grading," Gold Bulletin. vol. 38, No. 2, pp. 55-67 (2005), *available at* http://www.goldbulletin.org/downloads/Henderson_2_38.pdf.

(Continued)

*Primary Examiner* — Scott Kastler
*Assistant Examiner* — Vanessa Velasquez
(74) *Attorney, Agent, or Firm* — Finnegan, Henderson, Farabow, Garrett & Dunner LLP

(57) ABSTRACT

The present disclosure relates to white precious metal alloy compositions comprising at least one of platinum and palladium alloyed with gold, silver, and optionally one or more additional alloying elements. More specifically, and in one embodiment, the present disclosure relates to white precious metal alloy compositions that are suitable for the manufacture of jewelry and other finished articles. In addition, the present invention also relates to a method of manufacturing finished articles from such white precious metal alloy compositions.

11 Claims, No Drawings

OTHER PUBLICATIONS
English Language Derwent Abstract of DE 44 23 646, Aug. 17, 1995.
English Language Derwent Abstract of JP 3 130332, Jun. 4, 1991.
English Language Derwent Abstract of JP 3 130333, Jun. 4, 1991.
English Language Derwent Abstract of JP 3 130334, Jun. 4, 1991.
English Language Derwent Abstract of JP 3 130335, Jun. 4, 1991.
English Language Derwent Abstract of JP 3 130336, Jun. 4, 1991.
English Language Derwent Abstract of JP 6 184665, Jul. 4, 1995.
English Language Derwent Abstract of JP 9 078160, Mar. 25, 1997.
English Language Derwent Abstract of JP 9 137240, May 27, 1997.
English Language Derwent Abstract of JP 2000 336439, Dec. 5, 2000.
English Language Derwent Abstract JP 2004 060045, Feb. 26, 2004.
English Language Derwent Abstract of RU 2115755, Jul. 20, 1998.

* cited by examiner

WHITE PRECIOUS METAL ALLOY

FIELD OF THE INVENTION

The present invention relates to white precious metal alloy compositions. More specifically, and in one embodiment, the present invention relates to white precious metal alloy compositions that are suitable for the manufacture of jewelry and other finished articles. In addition, the present invention also relates to a method of manufacturing finished articles from white precious metal alloy compositions.

BACKGROUND OF THE INVENTION

In recent years, the popularity of white gold has steadily increased, resulting in a corresponding increase in the demand for white gold jewelry, particularly in Japan and China. Because it is inexpensive relative to platinum, white gold is particularly popular because the public cannot readily distinguish white gold jewelry from platinum jewelry. In other words, white gold jewelry is capable of maintaining the aura and exclusivity of platinum jewelry, at a substantial reduction in cost to the wearer.

Many jewelry manufacturers are capable of making jewelry from white gold. Indeed, because white gold exhibits better handling characteristics and a lower melting temperature than platinum, white gold jewelry is generally easier to manufacture than platinum jewelry.

Many different white gold alloy compositions are known in the art. These alloys generally comprise gold and at least one additional element, such as nickel, silver, platinum or palladium. Additional mixing elements, e.g., copper, may be used to round out the composition.

The addition of nickel to white gold gives the alloy a "whiter" base color at little cost. However, the addition of nickel increases the brittleness of the alloy, and may cause certain wearers to experience an allergic reaction.

Silver is the whitest of the metals, and unlike nickel, does not cause allergic reactions when included in white gold compositions. However, silver is relatively expensive and oxidizes upon exposure to air. Further, white gold alloys containing silver may be prone to tarnishing over time.

The addition of a combination of silver and nickel to white gold is also known. In these alloys, the relative content of silver and nickel is optimized to maximize the benefits and minimize the detriments of each element.

Platinum and/or palladium may also be added to white gold. However, due to their high cost, which may be more than twice that of gold, the inclusion of these elements into white gold is generally not economically feasible. This is particularly true if the resulting alloy is to be marketed as a white gold, which cannot command the same high price as platinum.

Due to the natural yellow color of gold, white gold alloys are not truly "white" in color. Depending on the composition of the alloy, the color of white gold may range from white with a slightly green tint to a white with a slightly yellow tint. This is true of all gold-based white gold jewelry, ranging from 10 karat white gold to 18 karat white gold.

Further, white gold alloys are also susceptible to corrosion, which can diminish the white color of finished articles, e.g., jewelry, manufactured from these alloys. To protect against such corrosion, articles manufactured from white gold are typically coated or plated with a layer of rhodium. While rhodium is a corrosion resistant and highly reflective white metal, it is more expensive than platinum. Thus, to be economically feasible, only very thin layers of rhodium are utilized. As a result, the layer of rhodium wears off gradually during normal use of the article, thereby exposing the underlying white gold alloy and its corresponding greenish or yellowish tint. To restore the article to a white color, rhodium must be re-plated/coated on the article. In the case of white gold jewelry this re-coating is generally necessary every six to eighteen months, assuming normal use and depending on the thickness of the rhodium layer.

While there are many ways to make white gold jewelry, the defining characteristic is that it contains relatively large amounts of gold. Gold is expensive, particularly in recent years. This high cost is a disadvantage, particularly in the case of gold jewelry, where gold may represent 80% or more of the finished product.

SUMMARY OF THE INVENTION

Accordingly, one embodiment of the invention is to provide novel white precious metal alloys that are an attractive alternative to platinum and white gold, and which exhibit several benefits, including a naturally bright white color, tarnish resistance, workability, and relatively low cost. Another embodiment of the present invention is to provide a method for manufacturing finished articles from such white precious metal alloys.

The present invention provides novel white precious metal alloy compositions comprising at least one of platinum and palladium alloyed with gold, silver, and optionally one or more additional alloying elements. These alloy compositions may be used, for example, to make a wide range of finished articles. Non-limiting examples of such finished articles include: jewelry products such as chain made from wire, chain made from plate, and chain made from castings; hollow wires; memorabilia; souvenirs; spectacle frames; table wares; and the base material of various plates, such as coins and watch bands. Of course, these uses are merely exemplary, and should not be considered limiting.

The alloy compositions of the present invention exhibit one or more beneficial characteristics, including, for example a naturally bright white color, resistance to color change, tarnish resistance, and excellent workability. In addition, jewelry manufactured from the inventive alloy compositions may be lighter in weight than similar-sized white gold jewelry. Finally, the inventive alloy composition is capable of being soldered via conventional methods, e.g., with a laser, a soldering powder and fire soldering. This capability is particularly advantageous when compared to platinum, which may be soldered only via specialized soldering methods that require a soldering paste.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DETAILED DESCRIPTION OF THE EMBODIMENTS

As explained in the summary of the invention, one embodiment of the present invention is to provide white precious metal alloy compositions that are a low cost alternative to white gold, yet which are capable of maintaining the aura and exclusivity of white gold.

The present invention provides white precious metal alloy compositions comprising at least one of platinum and palladium alloyed with gold, silver, and optionally one or more additional alloying elements. In particular, the present invention provides white precious metal alloy compositions comprising, in percent by weight: from greater than 0 to 35% of at least one of platinum and palladium, from 10 to 30% of gold, from 32 to 75% of silver, and from 0 to 4% of optional additional alloying elements.

The amount of platinum and/or palladium contained in the white precious metal alloy compositions may be varied within the above range. For example, one or both of platinum and palladium may be present in an amount ranging from 5 to 25% by weight. In non-limiting embodiments of the present invention, the amount of platinum and/or palladium ranges from 10 to 20%, more specifically from 10 to 16%, and still more specifically from 10-15% by weight.

The amount of gold contained in the white precious metal alloy compositions may also be varied within the above recited range. For example, gold may be present in an amount ranging from 10 to 25% by weight. In non-limiting embodiments of the present invention, the amount of gold ranges from 10-20%, more specifically from 10-19%, in particular 10-16%, and still more specifically from 10 to 11% by weight.

The amount of silver in the white precious metal alloy composition may also be varied within the above range. For example, silver may be present in an amount ranging from 32-65% by weight. In non-limiting embodiments of the present invention, the amount of silver ranges from 36-71%, more specifically from 36 to 66%, and still more specifically from 36-57% by weight. In a further non-limiting embodiment, the amount of silver in the white precious metal alloy composition may be determined by the presence or absence of nickel in the composition. In this embodiment, if nickel is present in the alloy, the amount of silver in the white precious metal alloy may range from 36-66% by weight. Alternatively, if the white precious metal alloy composition is nickel free, the amount of silver may range from 36-75% by weight.

The amount of optional additional alloying elements included in the white precious metal alloy may also be varied within the above recited range. For example, the white precious metal alloy may contain from 0 to 3%, more specifically from 0-2.5%, and still more specifically from 0 to 1.5% by weight of one or more additional alloying elements. In a non-limiting embodiment of the present invention, the total amount of optional additional elements added to the white precious metal alloy composition does not exceed 4% by weight. In another non-limiting embodiment, the total amount of optional additional elements added to the white precious metal alloy composition may exceed 4% by weight, with the proviso that amount of each individual optional element may not exceed 4% by weight.

As non-limiting examples of optional additional alloying elements that may be utilized in the inventive white precious metal alloy composition, mention is made of copper, nickel, and zinc. Of course, other elements and combinations of optional additional alloying elements may also be utilized in the white precious metal alloy composition.

If used, the optional additional alloying elements function to tailor the properties of the white precious metal alloy composition in desired ways. For example, up to 4% by weight of nickel may be added to the alloy as a bleaching or hardening agent. Further, up to 3.0% of copper may be added to improve ductility, corrosion resistance, and temperature resistance. Finally, up to 1.5% by weight of zinc may be added for various reasons, such as lowering the melting point of the alloy, improving the resistance of the alloy to atmospheric corrosion, to reduce surface roughness, and to increase the brightness of the surfaces of articles formed from the alloy, e.g., via casting.

Table 1 provides a listing of non-limiting examples of alloys falling within the scope of the present invention, as well as their associated properties:

TABLE 1

| Inventive Sample Number | wt % Au | wt % Pd | wt % Pt | wt % Ag | wt. % Other Elements | Vickers Hardness (aged) | Tensile Strength (Kgf/mm) | Elongation at Break (%) | Melting Temperature (° C.) |
|---|---|---|---|---|---|---|---|---|---|
| 01 | 11 | 10 | 0 | 75 | 3.4% Cu<br>0.6% Zn | 87-88 | 14.29 | 15.90 | 1060 |
| 02 | 16 | 15 | 0 | 66 | 2.55% Cu<br>0.45% Zn | 124-125 | 19.70 | 13.50 | 1018 |
| 03 | 16 | 16 | 0 | 65 | 3% Ni | 125-127 | * | * | * |
| 04 | 16 | 0 | 15 | 66 | 2.55% Cu<br>0.45% Zn | * | 12.40 | 37.28 | 1010 |
| 05 | 16 | 0 | 10 | 71 | 2.55% Cu<br>0.45% Zn | 126-128 | 18.10 | 21.50 | 1010 |
| 06 | 11 | 10 | 0 | 75 | 4% Ni | * | * | * | * |
| 07 | 16 | 15 | 0 | 65 | 3.4% Cu<br>0.6% Zn<br>0.0% Ni | * | * | * | * |
| 08 | 16 | 15 | 0 | 65 | 4% Ni | * | * | * | * |
| 09 | 30 | 35 | 0 | 32 | 2.55% Cu<br>0.45% Zn | 156-158 | 19.60 | 14.00 | 1136 |
| 10 | 20 | 10 | 0 | 67 | 2.55% Cu<br>0.45% Zn | 113-117 | 18.44 | 28.70 | 1022 |
| 11 | 20 | 20 | 0 | 57 | 2.55% Cu<br>0.45% Zn | 186-189 | 14.16 | 25.30 | 1078 |
| 12 | 10 | 35 | 0 | 52 | 2.55% Cu<br>0.45% Zn | 185-187 | 22.40 | 20.00 | 1068 |
| 13 | 10 | 25 | 0 | 62 | 2.55% Cu<br>0.45% Zn | 89-93 | 22.90 | 26.00 | 1093 |
| 14 | 25 | 35 | 0 | 37 | 2.55% Cu<br>0.45% Zn | 143-145 | 14.16 | 27.87 | 1178 |
| 15 | 16 | 35 | 0 | 46 | 2.55% Cu<br>0.45% Zn | 126-130 | 15.03 | 23.44 | 1165 |

*not measured

For comparative purposes, several conventional white precious metal alloy compositions were prepared, and their hardness, and melting temperature are reproduced below in Table 2.

TABLE 2

| Comparative Sample No. | wt % Au | wt % Ni | wt % Cu | wt % Zn | wt % Other elements | Hardness | Melting Temperature (° C.) |
|---|---|---|---|---|---|---|---|
| 01 | 75.0 | 10.0 | 12.5 | 2.5 | 0.0 | 230 V* | 950-910 |
| 02 | 75.0 | 13.5 | 8.5 | 3.0 | 0.0 | 198 V | 950-925 |
| 03 | 75.0 | 0.0 | 0.0 | 0.0 | 20% Pd, 5% Ag | 100 B | 1280-1272 |
| 04 | 58.7 | 15.6 | 18.5 | 7.2 | 0.0 | 170 B | 1010-920 |
| 05 | 41.7 | 13.0 | 38.3 | 7.0 | 0.0 | 150 B | 1050-940 |
| 06 | 0.0 | 0.0 | 0.0 | 0.0 | 95% Pd, 5% Ag | 100 V | 1450-1380 |

*V = Vickers Hardness;
B = Brinnell Hardness

As shown in Table 1, the exemplified inventive white precious metal alloy compositions exhibit similar properties to conventional white gold alloys, e.g., a Vickers hardness around 120-150, a tensile strength around 20 Kgf/mm, and a melting temperature around 1020° C. As a result, the inventive white precious metal alloy compositions can possess excellent workability, as compared to the workability of conventional white gold alloys.

All of the above inventive samples are suitable for use making finished articles. However, inventive samples 01-08 are particularly suitable for the manufacture of jewelry, such as rings, watch bands, snake chains, box chains, Milano chains, necklaces, earrings, and eyeglass frames. As used herein, the term, "Milano chain" refers to a stamping type chain made using an OMBI TAV-TA1 machine.

In addition, the tarnish resistance of the inventive white precious metal alloy compositions relative to silver jewelry was performed by immersing samples of the inventive alloy and conventional silver jewelry for a defined period of time in a synthetic perspiration liquid having the following composition:

Synthetic Perspiration Liquid

| Compound | Chemical Structure | Quantity |
|---|---|---|
| Urea | $(NH_2)_2CO$ | 50 g |
| Salt | NaCl | 100 g |
| Hydrochloric Acid | HCl | 25 ml |
| Lactic Acid | $C_3H_6O_3$ | 25 ml |
| Potassium Chloride | KCl | 35 g |
| Phosphoric Acid | $H_3PO_4$ | 1.5 ml |
| Sugar | — | 0.5 g |
| Albumin (egg white) | — | 0.5 g |
| Water | $H_2O$ | 100 ml |

Specifically, this comparative testing was carried out in the following manner. After heating the synthetic perspiration liquid to its boiling point, samples of the inventive white precious metal alloy composition and conventional silver jewelry were dipped into the liquid for three minutes. The samples were then visually inspected for evidence of any color change due to tarnishing. Samples of the inventive white precious metal alloy composition exhibited minimal to no evidence of a color change from their original white color after exposure to the synthetic perspiration liquid. In comparison, the samples of silver jewelry showed significant color change due to tarnishing.

The "whiteness" of the inventive white precious metal alloy composition was determined by comparing the color of plates of the inventive alloy to the color of plates composed of a standard 18 karat white gold alloy. Specifically, plates of the inventive white precious metal alloy composition and plates of a standard 18 karat white gold alloy where the plates of the inventive and comparative alloys were manufactured by melting the appropriate alloy and rolling the melt into a plate. The color of the resulting plates was determined by visual inspection. Plates manufactured from the inventive alloy exhibited a "whiter" base color than plates of a standard 18 karat white gold.

In addition, the resistance of the inventive white precious metal alloy compositions to color change was determined by observing the color change of the alloy in conditions simulating real world use. For example, samples of jewelry manufactured from the inventive white precious metal alloy composition were left in open air for three months, together with conventional silver jewelry. At the end of this time period, the samples of the inventive composition were compared to the samples of conventional silver jewelry. Visual inspection of these samples revealed that the inventive alloy compositions retained their white color, whereas the comparative silver samples exhibited evidence of tarnishing.

In addition, samples of the inventive white precious metal alloy compositions were given to several people to be worn daily for three-months to determine the effects of real world use and exposure to the elements (i.e., perspiration, soap, shampoo, water) on the alloy. After this time period, all of the samples were returned for inspection and testing. After cleaning with regular soap and ultrasonic treatment, visual inspection of the inventive samples revealed no evidence of tarnishing.

The present invention also relates to a method of manufacturing the inventive white precious metal alloy composition into finished articles, such as jewelry and stamped or cast articles.

As a non-limiting example of such a method, a chain manufactured from the inventive white precious metal alloy was manufactured via the following method.

As an example of the method of the invention, a first sample with a particular mix of elements in amounts corresponding to the inventive white precious metal alloy composition was melted in a continuous casting machine, resulting in a white wire alloy about 6 mm in diameter. A quality check to test hardness and elongation was performed at this point to make sure that the sample has properties similar to white gold. The wire was then drawn out to a size (either round or square, as required) specific to the requirement of the final product using a wire drawing/strip rolling machine, anywhere from 0.52 mm to 0.80 mm (this range is specific to Milano chains, other dimensions may be utilized). It was then rolled into a spool and fed into a chain making machine. At this point, another quality check in the form of strength impact test was performed, to again ensure that the sample matches the quality of white gold.

The resulting chain was then degreased (to remove oil and grease from the machine) and was then put into a stainless steel polishing ball machine to polish and to clean off the surface, and then hammered to even out the surface (other types of chain may require soldering to strengthen the links). A diamond cutting process was then utilized to bring out the shine of the chain. The chain was then cut to size and fitted with findings to make a finished sample. This finished sample was then put through a finishing stage where it was polished, cleaned and rhodium plated. Throughout these steps, the sample exhibited good workability and maintained its white color, even when the rhodium plate is stripped away. The sample was also comparable in hardness to white gold. Optionally, an annealing process may be performed between each of the above described steps to improve the workability of the sample.

In a further non-limiting embodiment of the present invention, the inventive white precious metal alloy composition was manufactured into a Milano chain via the following method:

A mix of materials containing 16% gold, 15% palladium, 66% silver, 0.9% zinc, and 2% copper was provided. This sample was melted together in a crucible with a CEIA Magma-12 continuous melting machine at 1020° C. and subsequently drawn to form an initial wire having a diameter of 7.35 mm. This wire was then subjected to the following processes:

| Process Name | Dimension (mm) | Annealing Temp. and Time | Vickers Hardness (HV) |
|---|---|---|---|
| Rolling | 5.05 × 5.05 | n/a | 131-141 |
| Annealing | 5.05 × 5.05 | 800° C. for 60 min. | 102-107 |
| Rolling | 3.45 × 5.85 | n/a | 137 |
| Annealing | 3.45 × 5.85 | 800° C. for 60 min. | 106-109 |
| Rolling | 1.96 × 7.10 | n/a | 148-150 |
| Annealing | 1.96 × 7.10 | 630° C. for 30 min. | 108-111 |
| Rolling | 1.27 × 7.52 | n/a | 94-96 |
| Annealing | 1.27 × 7.52 | 800° C. for 100 min. | 95-99 |
| Rolling | 0.65 × 7.70 | n/a | — |
| Annealing | 0.65 × 7.70 | 630° C. for 30 min. | 95-99 |
| Rolling | 0.35 × 7.90 | n/a | — |
| Rolling | 0.17 × 8.25 | n/a | — |
| Cutting | 0.17 × 6.35 | n/a | 165-162 |
| Oven | 0.17 × 6.35 | 610° C. for 30 min. | 107 |

The resulting gold strip was then fed into the machine to be punched and assembled into a chain. The resulting chain was then degreased and put into a stainless steel polishing ball machine to polish and to clean off the surface, and was then hammered to even out the surface and was then fed through the diamond cut process to make it shiny. Finally, the chain was finished and may be fitted with findings to different lengths to make a finished necklace or bracelet or other kind of products and rhodium plated.

Other than in the operating examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the above specific examples are reported as precisely as possible. Any numerical value, however, inherently contain certain errors necessarily resulting from the standard deviation found in their respective testing measurements.

Of course, the above examples methods are merely exemplary of the present invention, and should not be considered as limiting. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A white precious metal alloy consisting of:
from about 10 to about 20% by weight of platinum;
from about 10 to about 30% by weight of gold;
from about 32 to about 75% by weight of silver; and
from greater than 0 to about 4% by weight of one of nickel, copper, zinc, and combinations thereof.

2. The white precious metal alloy composition of claim 1, wherein platinum is present in said alloy in an amount ranging from about 10 to about 15% by weight.

3. The white precious metal alloy composition of claim 1, wherein gold is present in said alloy in an amount ranging from about 10 to about 15% by weight.

4. The white precious metal alloy composition of claim 1, wherein silver is present in said alloy in an amount ranging from about 36 to about 57% by weight.

5. The white precious metal alloy composition of claim 1, wherein when nickel is present in said alloy, it is present in an amount ranging from greater than 0 to about 3% by weight.

6. The white precious metal alloy composition of claim 5, wherein when nickel is present in said alloy, it is present in an amount ranging from greater than 0 to about 1.5% by weight.

7. The white precious metal alloy composition of claim 1, wherein:
if copper is present in the alloy composition, it is present in an amount ranging from greater than 0 to about 3% by weight; and
if zinc is present in the alloy composition, it is present in an amount ranging from greater than 0 to about 1.5% by weight.

8. A finished article, comprising the white precious metal alloy composition of claim 1.

9. The finished article of claim 8, wherein said article is chosen from jewelry, stamped, and cast articles.

10. A white precious metal alloy composition consisting of:
from about 10 to about 20% by weight of platinum;
from 10 to 19% by weight of gold;
from 32 to 65% by weight of silver; and
from greater than 0 to about 4% by weight of one of nickel, copper, zinc, and combinations thereof.

11. A method for making a finished article comprising:
providing a white precious metal alloy composition, said alloy composition consisting of:
from about 10 to about 20% by weight of platinum;
from 10 to 16% by weight of gold;
from 32 to 75% by weight of silver; and
from greater than 0 to about 4% by weight of one of nickel, copper, zinc, and combinations thereof; and
forming said white precious metal alloy composition into a finished article.

* * * * *